United States Patent [19]

Edwards et al.

[11] Patent Number: 4,898,326

[45] Date of Patent: Feb. 6, 1990

[54] TRACK JOINING SYSTEM

[75] Inventors: Clarence K. Edwards; Lawrence D. Edwards, both of Medford, Oreg.

[73] Assignee: Kadee Metal Products Co., Medford, Oreg.

[21] Appl. No.: 302,127

[22] Filed: Jan. 26, 1989

Related U.S. Application Data

[63] Continuation of Ser. No. 113,452, Oct. 28, 1987, abandoned.

[51] Int. Cl.[4] ..... E01B 23/00

[52] U.S. Cl. ..... 238/10 E; 403/329

[58] Field of Search ..... 238/10 R, 10 A, 10 C, 238/10 E, 10 F; 403/329; 446/121, 446

[56] References Cited

U.S. PATENT DOCUMENTS

| | | | |
|---|---|---|---|
| 1,142,150 | 6/1915 | Dorrill | 238/10 R |
| 2,534,458 | 12/1950 | Larrabee | 238/10 C |
| 2,764,357 | 9/1956 | Katryniak | 238/10 C |
| 2,765,581 | 10/1956 | Adler | 403/329 X |
| 4,066,211 | 1/1978 | Mak | 238/10 F |
| 4,150,789 | 4/1979 | Tong | 238/10 E |
| 4,179,066 | 12/1979 | Teter | 238/10 E |

FOREIGN PATENT DOCUMENTS

| | | | |
|---|---|---|---|
| 2135202 | 2/1973 | Fed. Rep. of Germany | 238/10 E |
| 17350 | 5/1984 | Japan . | |

OTHER PUBLICATIONS

Marklin Publication No. 68 650 AN 0782 ju, West Germany.

*Primary Examiner*—Margaret A. Focarino
*Assistant Examiner*—Frank H. Williams, Jr.
*Attorney, Agent, or Firm*—Kolisch, Hartwell & Dickinson

[57] ABSTRACT

The instant invention includes a track joining element which is operable to join two sections of track and to provide lateral and longitudinal positioning of the track sections relative one another. The joining elements include a tongue and a slot formed on each element. The tongue and slot have a common side which forms a linear guide path for engaging a like joining element on another section of track. The tongue is constructed and arranged to be clearance receivable in the slot on a second joining element. Interlocking means are provided to maintain the two elements in an engaged condition. In the preferred embodiment, interlocking means includes a leafspring mounted on the linear guide path. The spring has a free end which protrudes into the slot and engages a notch formed on the tongue of another joining element.

5 Claims, 2 Drawing Sheets

TRACK JOINING SYSTEM

This application is a continuation of prior filed application Ser. No. 07/113,452 filed Oct. 28, 1987 abandoned with filing of this continuation application.

BACKGROUND OF THE INVENTION

The instant invention relates to model railroad track and specifically to a track joining system which securely holds two sections of track together and provides alignment therefore.

Sectional model railroad track has been constructed in a variety of forms. In the simplest form, a section of track includes a pair of spaced apart, electrically conductive rails and an arrangement of ties extending between the rails, the ties being joined together to form the track section into the desired configuration, i.e., straight, or curved with a variety of radii.

Another form of sectional track includes the aforementioned elements which are secured to a section of roadbed to eliminate the necessity of laying a separate roadbed and then laying the sectional track on top thereof.

The simplest joining system consists of the positioning of a track connector, or fishplate, at the ends of the conductive rails. The connectors take the form of a thin piece of metal, which is formed substantially into a C-shape, and which is placed on the rail extending under the bottom side thereof and around a flange at the base of the rail. The only purpose of the connectors is to provide electrical continuity between two sections of track. The connectors are not intended to provide a physical restraining system for the track, and, although the connectors will prevent lateral movement of track sections relative to one another, they will do very little to prevent longitudinal movement which is required to keep the track sections from separating from one another.

The connectors are rather delicate objects, particularly in the smaller gauges (N scale and smaller). The connectors are frequently secured to the rails, one connector being secured to one of the rails at one end of the section and another connector being secured to the opposing rail at the other end of the section. The connectors extend beyond the ends of the rails, and as such, are subject to impact which may result in disfiguration, following which the connectors may not be operational to join sections of tracks and to provide an electrical connection therebetween. Because the connectors are easily damaged or distorted, assembly of sectional track must be performed by a person having a high degree of manual dexterity. Conventional track is not suitable for use by children and is difficult to manipulate for some adults.

When such track is assembled and disassembled, there is frequently lateral movement of the track sections relative one another. This results in an enlargement of the connector, which in turn results in poor electrical connection between track sections upon reassembly. Poor electrical connection between track sections will result in poor operation of the model trains which are run on the track.

Although some forms of joining systems have been developed which provide for the longitudinal and lateral alignment of sectional track, known systems involve complex structures which are difficult to form and which are not easily injection molded.

SUMMARY OF THE INVENTION

The instant invention includes a track joining element which is operable to join two sections of track and to provide lateral and longitudinal positioning of the track sections relative one another. The joining elements include a tongue and a slot formed on each element. The tongue and slot have a common side which forms a linear guide path for engaging a like joining element on another section of track. The tongue is constructed and arranged to be clearance receivable in the slot on a second joining element. Interlocking means are provided to maintain the two elements in an engaged condition. In the preferred embodiment, interlocking means includes a leaf-spring mounted on the linear guide path. The spring has a free end which protrudes into the slot and engages a notch formed on the tongue of another joining element.

An object of the instant invention is to provide a track joining system which provides vertical, longitudinal and lateral alignment between track sections.

Another object of the instant invention is to provide a system which provides for alignment of a roadbed in a piece of sectional model railroad track.

Yet another object of the instant invention is to provide a system which will protect track connectors from damage.

Another object of the instant invention is to provide a system which provides alignment of a connector with a rail prior to actual engagement of the connector and the rail.

Still another object of the instant invention is to provide a system which incorporates alignment and interlocking elements in a unitary structure.

A further object of the invention is to provide a system which is easy and inexpensive to construct and which incorporates structures having simple configurations.

These and other objects and advantages of the instant invention will become more fully apparent as the description which follows is read in conjunction with the drawings.

DETAILED DESCRIPTION OF THE FIRST EMBODIMENT

Figure 1:
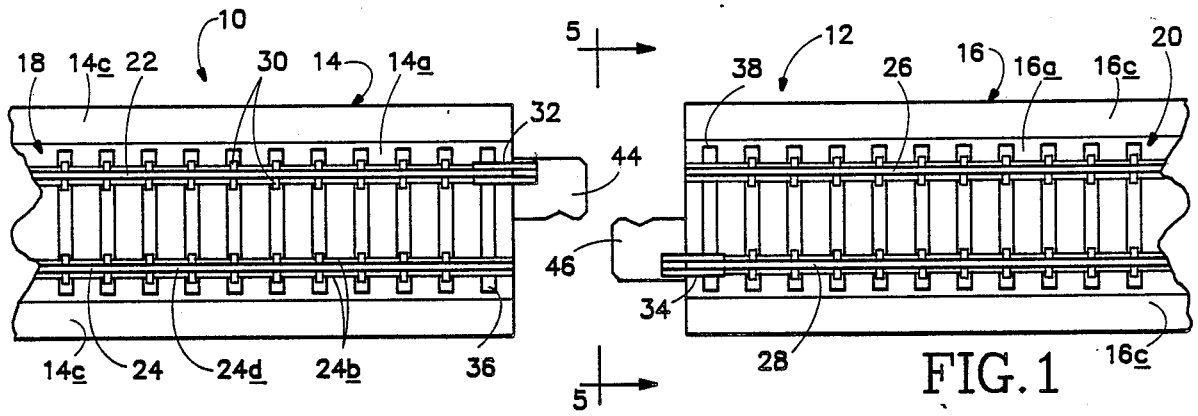
FIG. 1 is a top plan view of a first embodiment of two track sections incorporating the joining system of the invention.
Figure 2:
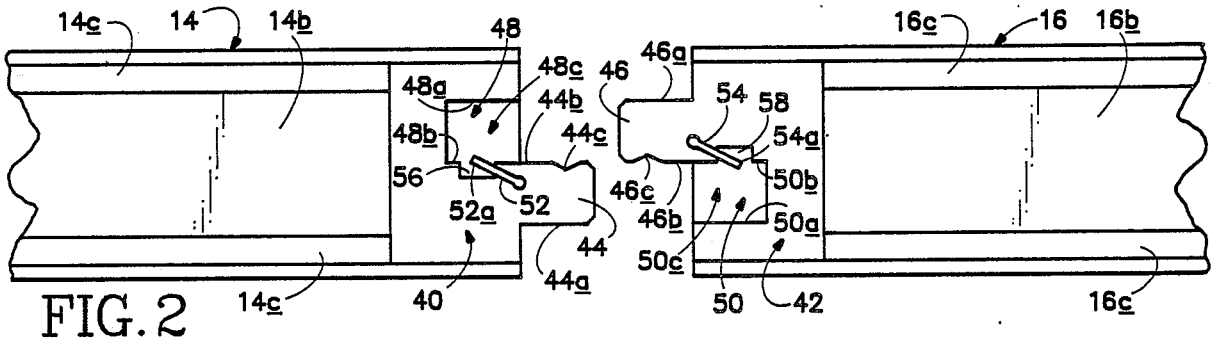
FIG. 2 is a bottom plan view of the track sections of FIG. 1.

Referring now to FIGS. 1 and 2, portions of two pieces of sectional model railroad track are shown generally at 10 and 12. In this embodiment, each section of track includes an elongate roadbed deck 14, 16 having upper surfaces 14*a*, 16*a* and lower surfaces 14*b*, 16*b*, respectively.

Figure 5:
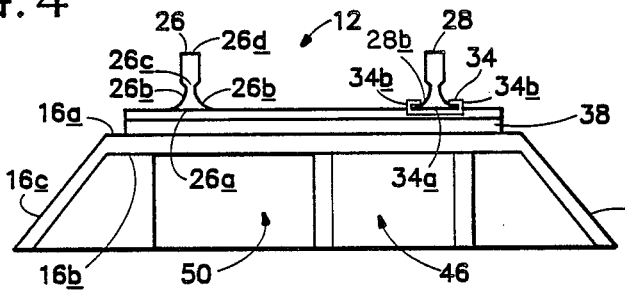
FIG. 5 is an end view of a track section of FIG. 1, taken generally along the line 5—5 of FIG. 1.

An array 18, 20, of model railroad ties is located on the upper surface 14*a*, 16*a* of each deck. Rails 22, 24 and 26, 28 are positioned in a spaced apart relationship on tie arrays 18, 20, respectively. The rails are electrically conductive and are generally formed from brass or nickle-silver alloy. Referring momentarily to FIG. 5, rails 26, 28 are shown in end view. Each rail includes a base, such as 26*a*, having flanges 26*b* extending from either side thereof. A central web 26*c* extends upward from the base and connects with a rail head 26*d*.

Referring again to FIGS. 1 and 2, the rails are secured to the ties by means of rail spikes 30 which extend over the rail flanges to hold the rails on the ties. In this embodiment, the roadbed deck, tie array and spikes are formed in an injection molding process and the rails are inserted between the spikes on top of the ties with the spike heads extending over the flanges.

Fishplates or connectors 32, 34 are secured to the ends of rails 22, 28, respectively. The connectors may be permanently attached, as by soldering, or may be frictionally, removably secured. Referring again to FIG. 5, connector 34 may be seen to be a C-shaped structure having a connecting web 34*a* joining to curved portions 34*b* which extend around the rail flanges 28*b*. The connectors are generally formed of thin metal plate of the same type of metal used to form the rails. As shown in FIG. 5, tie 38 is formed with less height than that of the remaining ties in the array to allow insertion of connector 34 onto the rail end while allowing clearance between central web 34*b* and the top of tie 38. Ties 36, 38 on sections 10 and 12, respectively, do not include spikes 30 to further facilitate placement of the connectors on the rail ends.

Referring again to FIGS. 1 and 2, section joining elements 40, 42 may be seen to underlie roadbeds 14, 16, respectively. In this embodiment, the joining elements are identically formed, unitary structures. In the preferred embodiment, interlocking means are provided on at least one joining element on a track section. Each joining element includes a tongue 44, 46, which in the preferred embodiment has a rectangular form having spaced apart parallel sides 44*a*, 44*b* and 46*a*, 46*b*, respectively. Each tongue has a notch or indent 44*c*, 46*c*, also referred to herein as second interlocking means, formed in sides 44*b*, 46*b*, respectively. The tongues are constructed such that they protrude beyond the end of their respective decks and underlie the rail on a section of track. In the case of rails 22, 28, tongues 44, 46 extend beyond the ends of connectors 32, 34, to minimize the likelihood of damage to the connectors.

The joining elements also include slots or sockets 48, 50 which also have substantially rectangular forms and spaced apart parallel sides 48*a*, 48*b* and 50*a*, 50*b*. Slots 48 and 50 also have an open end, shown generally at 48*c*, 50*c*, respectively, which, in the preferred embodiment is disposed below and aligned with the end of roadbed decks 14, 16. The slots underlie a rail on the track section. Referring now to joining element 40, slot 48 has a shared or common side 48*b* with a shared or common side 44*b* of tongue 44. The common side runs along a medial edge of the slot and tongue such that the medial edge of the slot is continuous with the medial edge of the tongue. A medial edge forms a linear guide path which may be used to align two sections of track.

The joining elements are constructed and arranged such that the tongue on a first section of track will be snuggly, clearance receivably received in the slot on a second section of track.

A leaf-spring, or spring means, 52, 54 is mounted in a suitably formed orifice on elements 40, 42, respectively. Springs 52, 54, also referred to herein as first interlocking means, have free ends 52*a*, 54*a* which protrude into their respective slots along medial edges 48*b*, 50*b*, respectively. A recessed area 56, 58 is formed on the medial edge behind each spring to allow deflection of the free end of the spring thereinto. The spring comprises what is referred to herein as a resilient element which is mounted at a side of the socket.

Figure 4:
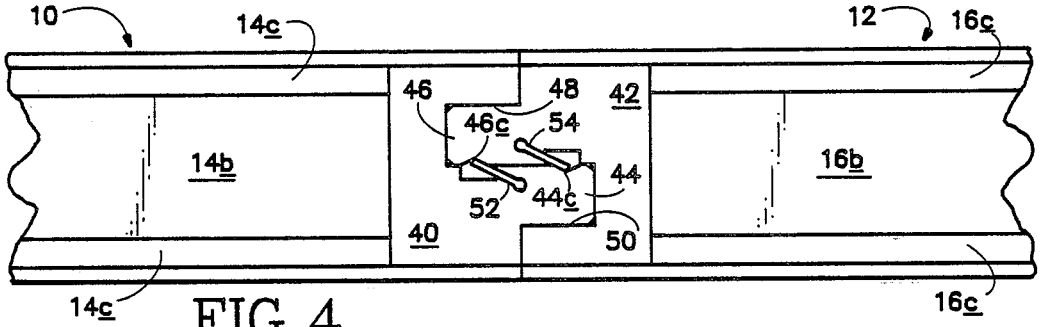
FIG. 4 is a bottom plan view of the track sections of FIG. 3.

Referring now to FIG. 4, track sections 10 and 12 are shown in an engaged condition wherein the tongues on elements 40 and 42 have been received in their respective slots. Springs 52, 54, also referred to herein as tongue engaging means, have co-acted with notches 46*c*, 44*c*, respectively to provide longitudinal retention of sections 10 and 12 relative to one another. In the preferred embodiment, the notch is formed in the medial side of the tongue such that the spring, when engaging the notch, tends to urge the joining elements into an interlocked condition. As the joining elements are brought together, the springs pass the leading edge of the notch and encounter an incline. The resilient nature of the spring in connection with the incline urges the tongue into its fully seated position in the slot.

In the first embodiment, elements 40, 42 may be formed of a material such as styrene plastic, which has a first, known modulus of elasticity. Springs 52, 54 may be formed of a material such as acetil plastic, having a second modulus of elasticity which is greater than that of the material forming elements 40, 42. Alternately, springs 52, 54 may be formed of a metallic material. The criteria for the material used to form springs 52 and 54 is that it be flexible and have a high memory.

Figure 3:
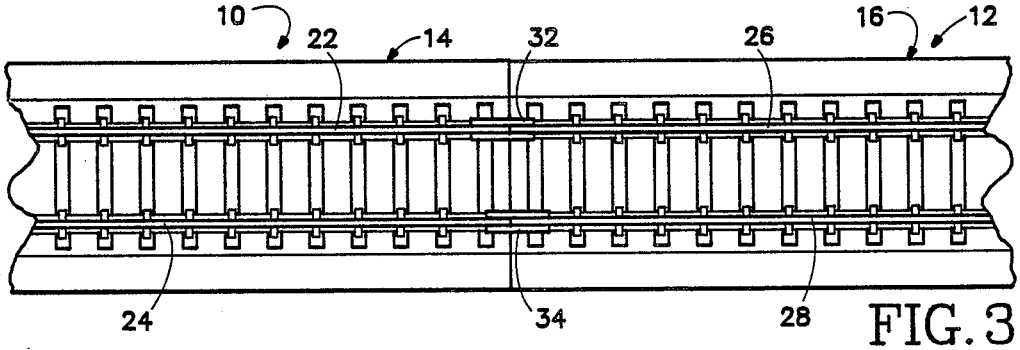
FIG. 3 is a top plan view of the track sections of FIG. 1, in a joined condition.

Referring now to FIG. 3, it may be seen that when sections 10 and 12 are assembled such that the track joining elements are engaged, connectors 32 and 34 are joined with rails 26 and 24, respectively, thereby forming an electrical connection between the rails on the section.

Detailed Description of an Alternate Embodiment

Figure 6:
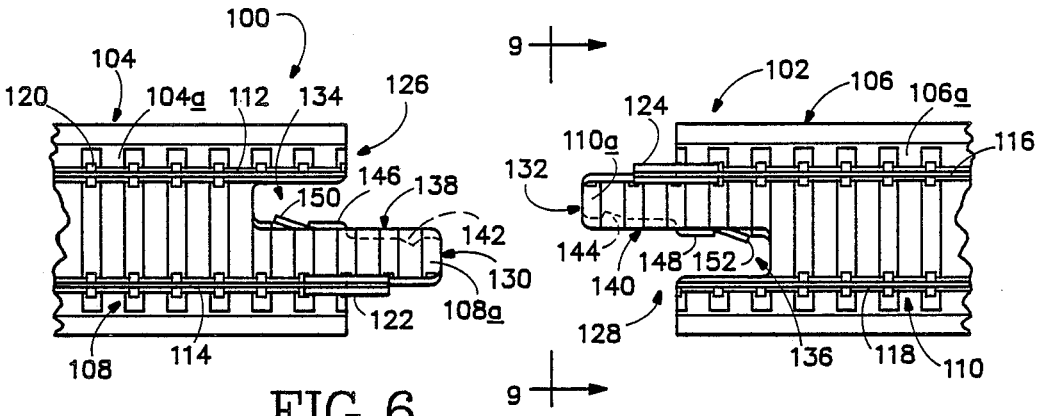
FIG. 6 is a top plan view of an alternate embodiment of two track sections incorporating the joining system of the invention.
Figure 7:
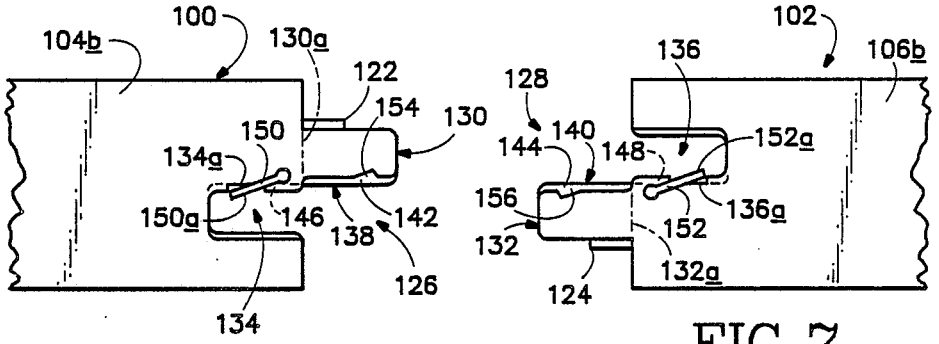
FIG. 7 is a bottom plan view of the track sections of FIG. 6.

Referring now to FIGS. 6 and 7, portions of two pieces of sectional model railroad track are shown generally at 100 and 102. In this embodiment, each section of track includes an elongate roadbed deck 104, 106 having upper surfaces 104*a*, 106*a* and lower surfaces 104*b*, 106*b*, respectively.

Decks 104 and 106 each have an array, 108, 110, respectively, of railroad ties, such as ties 108*a*, 110*a*, located on the upper surface 104*a*, 106*a* thereof. Rails 112, 114 and 116, 118 are positioned in a spaced apart relationship on tie arrays 108, 110, respectively. The rails in this embodiment are formed as are the rails described in connection with the first embodiment, and are secured to the ties by means of spikes 120.

In this embodiment, the rail bed deck, tie array and spikes are formed as by injection molding, with the ties either integrally formed with the roadbed or formed in a separate process and joined to the roadbed as an integral array.

As in the fist embodiment, fishplates or connectors 122, 124 are secured to the ends of rails 114, 116, respectively. The fishplates are formed as are fishplates 32, 34, described in connection with the first embodiment.

Section joining elements 126, 128, in this embodiment, are integrally formed with the ends of decks 104, 106, respectively. A comparison of FIGS. 5 and 9 will illustrate that the roadbed deck utilized with the first embodiment of the invention is considerably thicker than the deck utilized with the second embodiment and, the second embodiment does not have a hollow or wasted area under the deck as does the deck used in conjunction with the first embodiment. However, it is still possible to construct the section joining element in accordance with the invention wherein the joining elements are integrally formed with the roadbed deck.

Joining elements 126, 128 include tongue portions 130, 132 and slot portions 134, 136, respectively. As in the first embodiment, the second preferred embodiment of the invention incorporates tongue portions and slot portions which have a substantially rectangular shape and which have a medial, or common side 138, 140 which is continuous along the medial edge of the tongue and slot on a given element. Again, the medial edge forms a linear guide path which may be used to align two sections of track.

Tongues 130, 132 include a flange 138, 140 which extends along the side thereof and which is received in a complimentary flange-receiving structure 142, 144 which extends along the side of slots 134, 136, respectively. The flanges are provided to enhance the stability of two joined sections vertically relative to one another.

Interlocking means in this embodiment is substantially similar to that in the first described embodiment and includes leaf-springs 150, 152 which are mounted at the sides of slots 134, 136, respectively. The springs have free ends **150*a*, 152*a* which, when deflected, are received into recesses 134*a*, 136*a*, formed in the sides of slots 134, 136, respectively. Tongues 130, 132 have notches 154, 156 which coact with the free ends 150*a*, 152*a* of the springs to provide longitudinal retention of track sections 100, 102** relative to one another.

Figure 8:
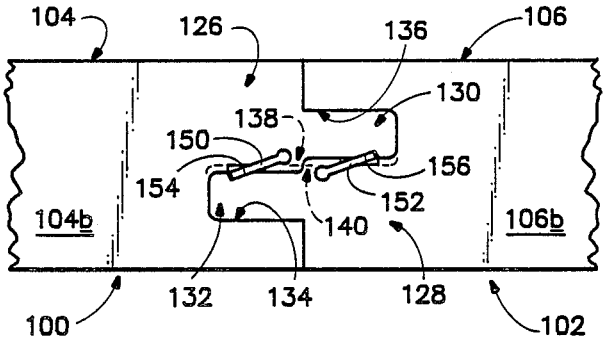
FIG. 8 is a bottom plan view of the track sections of FIG. 6, in a joined condition.

Referring now to FIG. 8, sections 100, 102 are shown in an engaged condition with tongues 130, 132, received in slots 136, 134, respectively. Springs 150, 152 are engaged with notches 156, 154, respectively to maintain the two sections of track in an interlocked condition.

Joining track sections having the section joining element of the invention with track which does not have such elements is easily accomplished by removing tongues 130, 132 along the line indicated at **130*a*, 132*a* (FIG. 6**) and inserting the removed tongue into the slot, thereby forming a solid deck surface. The track section may then be joined to conventional flexed, sectional or hand-laid track, and secured in place.

As shown in the drawings, the arrangement of the tongue and connectors is such that the tongue provides a protective shield about the base of the connector. Additionally, the tongue, slot and connector are constructed in the preferred embodiments such that the tongue will be more than half way received in the slot prior to the connector making initial contact with the rail on the section to which it is being joined. This construction provides for minimal lateral shifting of the connector and rail relative one another during the assembly and disassembly of the sectional track, thus preventing the connector from being laterally widened, which would subsequently result in a poor electrical connection between rails on adjoining sections. Provision of a joining element of the invention enables use of track incorporating the joining system by most children and virtually all adults.

Once the sections are joined, as depicted in FIGS. 3, 4 and 8, vertical, longitudinal and lateral alignment between the rails and the roadbed is provided. Additionally, longitudinal locking is assured by the co-action of the spring means and the notches in the tongues, collectively referred to as interlocking means.

From a manufacturing standpoint, the one piece construction of the section joining elements disclosed in the first embodiment provides for simple, cost efficient construction. The elements may be stamped or molded and require very simple working tools to form the elements into the desired shape. The installation of the spring into the elements is the only assembly step which is required. It is conceivable that the spring could be molded as an integral portion of the element, thereby removing the assembly step. Once the element and spring are assembled, the completed element is positioned on the underside of the roadbed and secured in place, as by adhesive.

Figure 9:
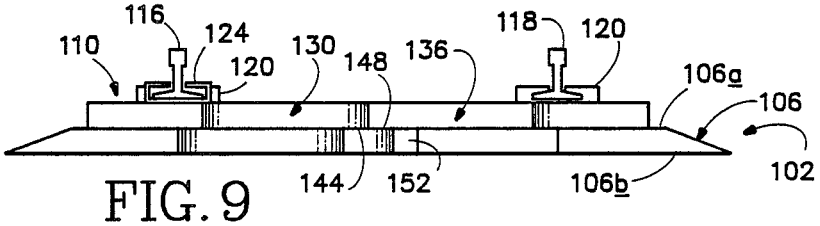
FIG. 9 is an end view of a track section of FIG. 6, taken generally along the line 9—9 in FIG. 6.

Manufacturing of the second embodiment disclosed herein, may, as previously noted, be accomplished through an injection molding process. Again, it is only necessary to install the spring, which also could be molded as an integral portion of the element. The section joining element, being formed as an integral portion of the roadbed, may be formed before the installation of the track on the roadbed element. The spikes which underlie the connectors may need to be modified to provide insertion of the connector, as depicted in FIG. 9.

Thus, a track joining system has been disclosed which provides for easy, accurate joining of sectional model railroad track. The system provides for three axis alignment of a track roadbed and rails while simultaneously providing protection for track joining connectors which extend beyond the ends of the roadbed.

The invention is not restricted to the particular embodiments which have been described, since variations may be made therein without departing from the scope of the invention as defined in the appended claims.

It is claimed and desired to secure as letters patents:

1. For a model railroad track comprising of a pair of elongate track sections disposed with one end of one track section opposite one end of the other track section, interconnecting means detachably interconnecting the track sections comprising:

a one-piece, non-flexible socket and tongue element mounted on said one section and another one-piece, non-flexible socket and tongue element mounted on the other track section, each of said elements including a socket portion having an outer open end disposed at the end of the track section mounting the element and the socket portion extending in an axial direction inwardly on the track section mounting the element to an inner end, and each element further including a rigid tongue portion disposed laterally of the socket portion extending in an axial direction outwardly of the track section mounting the element to a terminal end, the socket portion of each element having detachably lodged there within the tongue portion of the other element, each socket portion and each tongue portion having opposed sides generally paralleling the axis of the track section and spaced from each other in a horizontal direction, and the socket portion sides including end expanses adjacent the inner end of the socket portion and disposed on either side of and seating the terminal end of the tongue portion lodged within the socket portion, and the socket portion sides further including entering expanses adjacent the open end of the socket portion disposed on either side of and seating the tongue portion lodged within the socket portion, said end and entering expanses collectively inhibiting relative lateral skewing of the tongue portion within the socket portion, and a resilient locking spring detachably holding each tongue portion lodged within a socket portion, said spring being mounted on one of said sides of one of said portions and engageable with one of said sides of the other of the portions preventing relative axial displacement of the tongue portion relative to the socket portion, engagement with said one of said sides of the other of said portions being at a location disposed intermediate said end and said entering expanses of the socket portion, said spring being a leaf spring having an inner mounted end on said one portion and an outer free end, the leaf spring inclining extending from its inner end to its free end in the direction that said other portion moves relative to the one portion in lodging of the tongue portion within a socket portion.

2. The interconnecting means of claim 1, wherein, in each element, one of said sides of the socket portion is a medial edge and one of said sides of the tongue portion is a medial edge, and the medial edge of the socket portion is a continuation of the medial edge of the tongue portion.

3. The interconnecting means of claim 1, wherein the side of said one portion having said spring mounted thereon includes a flange extending therealong and the side of the other of said portions includes flange-receiving structure extending therealong receiving said flange.

4. For a model railroad track comprising a pair of elongate track sections disposed with adjacent ends opposite each other, interconnecting means detachably joining the adjacent ends of the track sections comprising:

a one-piece, non-flexible socket and tongue element mounted on each track section, each element including a socket portion having a substantially rectangular outline with spaced apart parallel sides extending axially of the track section and spaced from each other in a horizontal direction, the socket portion having an open end at the end of the track section and extending inwardly from said open end on the track section, and each element further including a tongue portion having substantially rectangular outline with spaced apart parallel sides extending axially of the track section disposed at the end of the track section laterally to one side of the side of the socket portion and extending outwardly from the end of the track section, the tongue portion in one track section having an outline substantially matching the outline of the socket portion in the other track section and the tongue portion in one track section being removably lodged in the socket portion of the other track section with said sides of the tongue portion engaging said sides of the socket portion to prevent relative lateral skewing of the two portions, and a resilient spring mounted on each socket and tongue element having a free end which protrudes into the socket portion of the element inwardly from its end, the tongue portion lodged in the socket portion having receiving means one of said sides thereof which receives the protruding end of the spring and said receiving means and the end of the spring cooperating to prevent relative axial displacement of a tongue portion from a socket portion.

5. The means of claim 4, wherein the spring comprises a leaf spring, and the spring, extending from its mounting toward its free end inclines rearwardly toward the rear end of its respective socket portion.

* * * * *